US005425311A

United States Patent [19]

Sullivan, Jr.

[11] Patent Number: 5,425,311

[45] Date of Patent: Jun. 20, 1995

[54] HYBRID WARHEAD

[75] Inventor: John D. Sullivan, Jr., Edgewood, Md.

[73] Assignee: The United States of America as represented by the Secretary of the Army, Washington, D.C.

[21] Appl. No.: 364,679

[22] Filed: May 12, 1989

[51] Int. Cl.[6] ..... F42B 12/46

[52] U.S. Cl. ..... 102/363; 102/364

[58] Field of Search ..... 102/363, 364, 365

[56] References Cited

U.S. PATENT DOCUMENTS

| | | | |
|---|---|---|---|
| 3,320,881 | 5/1967 | Brett et al. | 102/23 |
| 3,399,468 | 9/1968 | Gahle | 35/25 |
| 3,570,401 | 3/1971 | Euker | 102/6 |
| 3,730,093 | 5/1973 | Cummings | 102/6 |
| 3,786,756 | 1/1974 | Looger | 102/65 |
| 4,132,169 | 1/1979 | Gay et al. | 102/6 |
| 4,157,928 | 6/1979 | Falterman et al. | 149/109.2 |
| 4,273,048 | 6/1981 | Aley et al. | 102/363 |
| 4,297,949 | 11/1981 | Glass et al. | 102/229 |
| 4,318,343 | 3/1982 | King | 102/365 |
| 4,463,680 | 8/1984 | Sayles | 102/363 |
| 4,493,262 | 1/1985 | Hutcheson | 102/363 |

OTHER PUBLICATIONS

Sullivan et al. *Cane Tip Parametric Studies*, Jan. 1983 U.S. Armament Res.+Dev. Comm.

SIR H. 161, Sullivan, Issued Nov. 4, 1986.

SIR H 162, Sullivan, Issued Nov. 4, 1986.

*Primary Examiner*—Peter A. Nelson

*Attorney, Agent, or Firm*—Freda L. Krosnick; Paul S. Clohan; Muzio B. Roberto

[57] ABSTRACT

A hybrid fuel-air warhead having a housing containing a cylindrical body of reactive liquid surrounded by a housing containing a cylindrical body of reactive dust. A means to burst the two housings is provided along with a number of disks and end caps used to facilitate the turbulent mixing of the reactive liquid and reactive dust and to provide control of the cloud height.

12 Claims, 2 Drawing Sheets

HYBRID WARHEAD

RIGHTS OF THE GOVERNMENT

The invention described herein may be manufactured, used and licensed by or for the United States Government for Governmental purposes without payment to us of any royalty thereon.

BACKGROUND OF THE INVENTION

1. Field of the Invention

The present invention is a fuel-air explosive device and directed towards a novel structure designed to safely separate a body of reactive dust and reactive liquid prior to air dispersion and detonation. The invention is termed a hybrid warhead because it combines the features of dust warheads with liquid warheads.

2. Description of the Prior Art

The prior art consists of fuel-air warheads which employ liquid only or those which employ dust only. Liquid only fuel-air warheads have been articles of military research since 1960 and dust only fuel-air warheads since 1981. The limitation of liquid only fuel-air warheads is that they are medium pressure, large area attack warheads. The limitation of dust only fuel-air warheads is that they are high pressure, small area attack warheads. More kinds of targets are vulnerable or greater damage done if a warhead produces more pressure over a larger area. The present invention combines the features of dust and liquid warheads into a high-pressure, medium-area-attack fuel-air warhead.

Attempts to mix or dissolve dust in liquid has presented considerable problems in the past such as demonstrating that they are compatible, that they do not react immediately or that long term storage will not cause them to become unstable. Time consuming experiments were involved for each selected combination of dust and liquid. The present invention separates the dust and liquid thus compatibility, adverse reaction or long term storage problems are overcome.

The present invention allows explosive mixing of reactive dust and reactive liquid to take place without first proving their compatibility. The present invention also allows the warhead designer to select combinations which offer high pressure out to distances that are significant for maximum effects.

It therefore may be appreciated that there is a great need for a fuel-air warhead that will offer the advantages of both the liquid only and dust only warheads.

OBJECTS AND SUMMARY OF THE INVENTION

It is therefore a primary object of the invention to provide a mechanical structure that safely separates reactive, shock-sensitive compounds for long periods of storage.

Another object of this invention is to provide a structure that will facilitate the explosive-mixing of reactive dust and reactive liquid into a cloud that can be detonated against a military target.

A still further object of this invention is to provide a structure that will provide a degree of control over the explosive cloud shape and the turbulent mixing of the reactive dust and reactive liquid.

The central element of this invention is the use of an explosive force to push liquid fuel and the surrounding dust particles outwards, detonate the resulting cloud, and create a blast pressure greater than a liquid only fuel-air cloud. The present invention eliminates the safety hazard of mixing potentially reactive compounds and also allows the option of detonation of the liquid portion separate from the dust detonation if desired. The present invention employs a housing to contain the reactive liquid surrounded by a larger housing containing the reactive dust. A method to burst both housings is provided as well as a means to facilitate the mixing of the liquid and dust during airborne dispersion. Cloud height can be controlled via the placement of metal end caps.

DETAILED DESCRIPTION OF THE PREFERRED EMBODIMENTS

Figure 1:
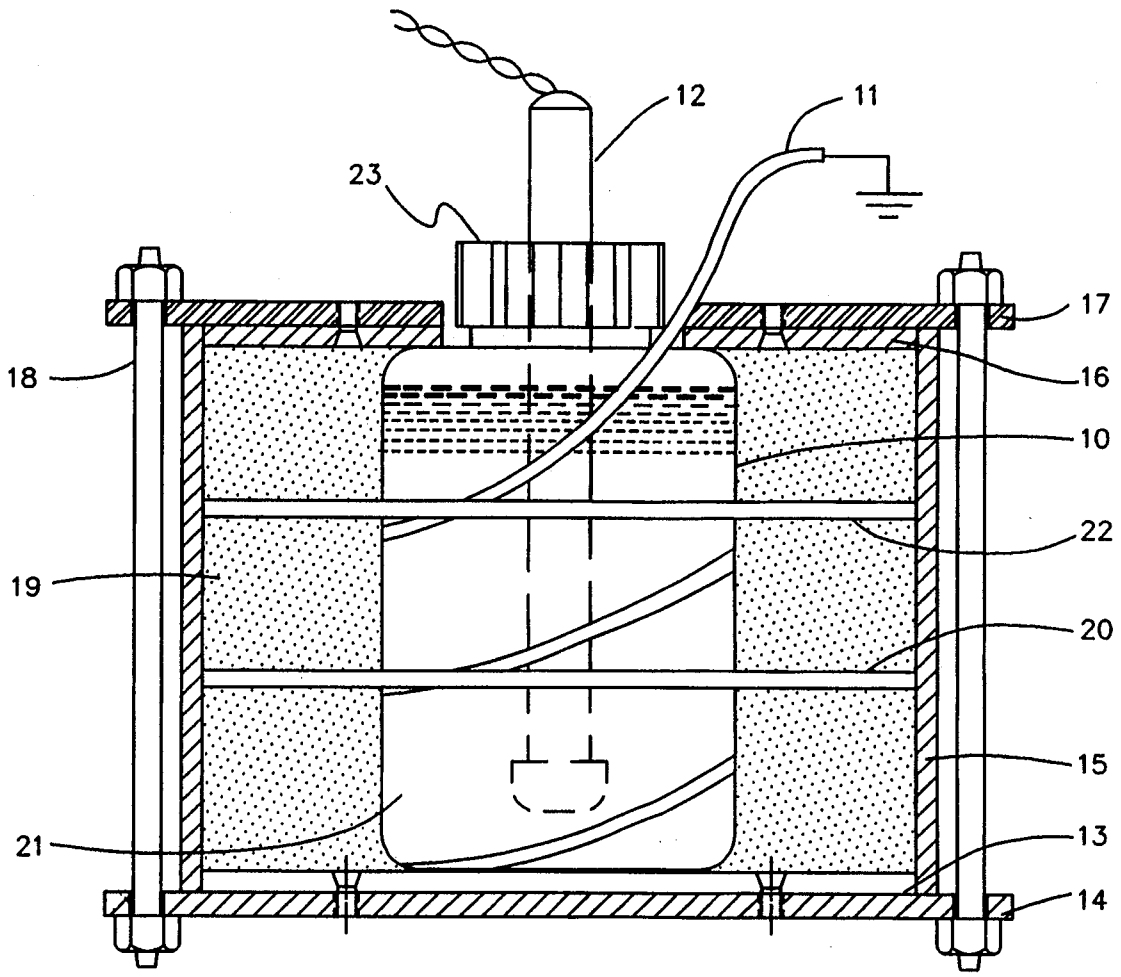
FIG. 1 is a cutaway view of the present invention.

Referring now to FIG. 1, the embodiment used to disperse 20 lbs. of pentolite (a mixture of equal parts of pentaerythritol tetranitrate and trinitrotoluene) dust and 10 lbs. of normal propyl nitrate (NPN) liquid is shown. The inner housing 10 is a 1 gallon plastic container. The inner housing 10 is modified by scoring the outside with a hot-tipped iron to facilitate controlled breaking. The inner housing 10 is wrapped on the outside with a grounding strap 11 to provide electrical grounding during loading and arming. A burster 12 is inserted in the top of the inner housing 10 and a cap 23 is installed. In practice, the burster 12 and cap 23 may preferrably be one unit. Burster 12 consists of a plastic or glass tube containing a folded detonating cord and an electric detonator sealed at the top with an inert putty. Burster 12 comprises the propelling force for dispersal of the reactive liquid 21 and the reactive dust 19. The inner housing 10 is attached with glue at the bottom to a lower disk 13 made of wood and a bottom plate 14 made from aluminum or steel is attached by four screws 25. The lower disk 13 is glued at the edges to the inside of outer housing 15 which is made from cardboard and has a 12 inch inside diameter and $\frac{1}{4}$ inch wall thickness. The outer housing 15 is scored on the inside with a razor blade using a template. A useful pattern that gives multiple breaks is vertical scores numbering n, where $n=6$ to 10, crossed by n scores at 45 degrees. The outer housing 15 is fabricated just tall enough so that an upper disk 16 rests on the shoulder of the inner housing 10 and is even with the height of the outer housing 15. A top plate 17 made from aluminum or steel, used to control cloud height, is attached to upper disk 16 by four screws 24 and the corners of the top plate 17 and bottom plate 14 are attached together with four $\frac{3}{8}$–16 threaded rods 18. The top plate 17 remains on during the dispersal process which keeps the cloud height low and the reactive dust 19 travels mainly outwards. The rods 18 survive the dispersal process of the contents but may be sheared when the cloud is caused to explode; the top plate 17 is then thrown several stories high.

The hybrid warhead is loaded with a reactive liquid 21 and a reactive dust 19 as follows: the inner housing 10 is grounded via the grounding strap 11 and reactive dust 19 added to about $\frac{1}{3}$ the height of the outer housing 15 and lower interior disk (having a cut-out center) 20 is slipped down the interior housing 10 and rests on the reactive dust 19. Another layer of reactive dust 19 is added up to about ⅔ the height of the outer housing 15, with an upper interior disk 22 slipped down the interior housing and resting on the reactive dust 19. A final amount of reactive dust 19 is added up to the top of outer housing 15 resulting in three channels which promote mixing of the reactive dust 19 and the reactive liquid 21. With the structure still grounded, cap 23 is unscrewed and reactive liquid 21 poured into the interior housing 10. The burster 12 is then put in place. Until this loading begins, the reactive dust 19 and the reactive liquid 21 have never been together in close-proximity. The electrical hook-up of burster 12 proceeds as usual with any explosive. When the burster 12 is exploded, the inner housing 10 and the outer housing 15 will rupture causing the dispersion and airborne mixing of the two reactive compounds into an expanding, pancake shaped cloud. The cloud itself can be detonated after it covers a large area by a time-delayed charge placed in the cloud. The placement and timing of the time-delayed charge is left to the munitions designer.

This invention will succeed in dispersing any combination of liquid and powder into air. The described combination of NPN and pentolite was chosen because of the object of obtaining an enhanced detonation. NPN is a monopropellant and is detonable in a dense, small cloud of air. The usual fuel-air explosive fuels will not detonate in dense clouds. The present invention, however, is not sensitive to choice of materials dispersed. Other liquids such as ethylene oxide or propylene oxide may be used but were not tested. Discussion of these follows later. Reactive dusts such as TNT (2,4,6-trinitrotoluene), RDX (1,3,5-trinitro-1,3,5-triazacyclohexane), HMX (1,3,5,7-tetranitro-1,3,5,7-tetraazacyclooctane), PETN (pentaerythritol tetranitrate) and nitroguanidine are also feasible.

Figure 2:
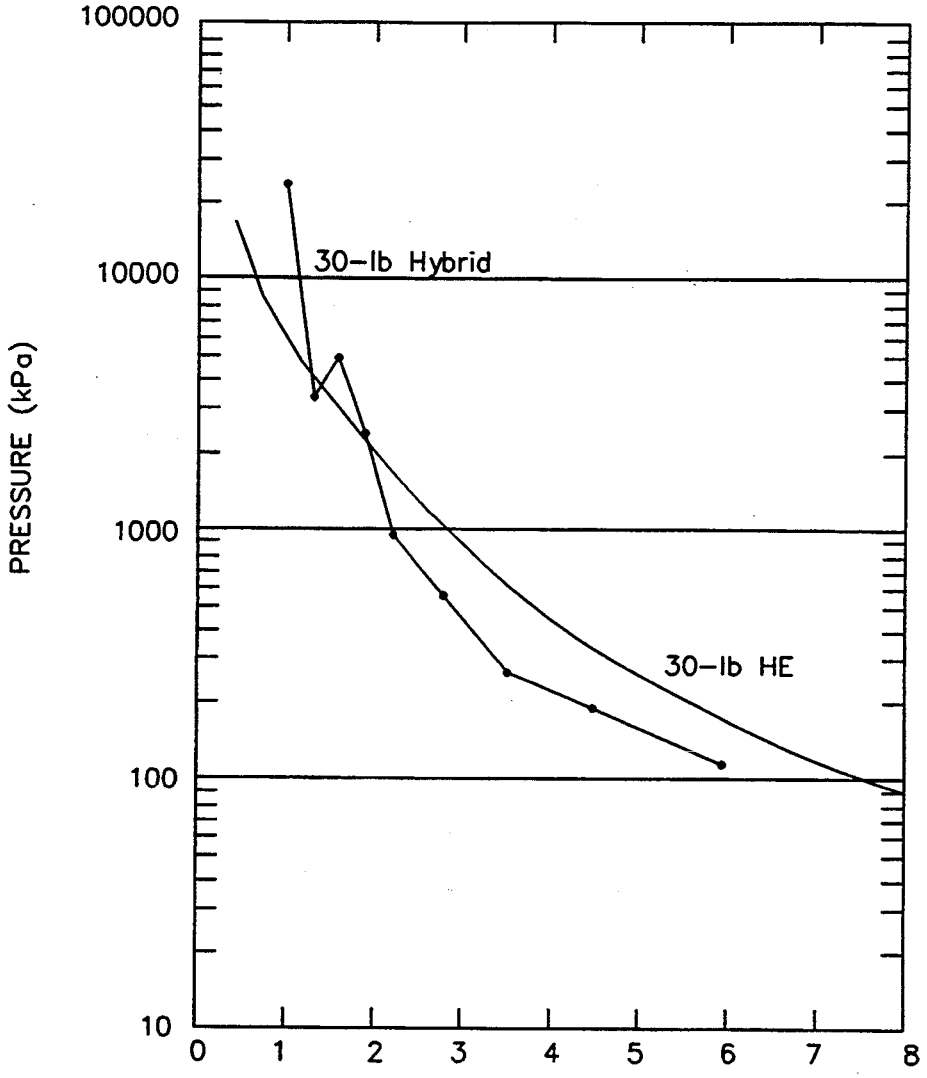
FIG. 2 is a graph which shows a comparison between the present invention and an equal weight of high explosive alone.

Use of a large diameter inner housing 10 results in the shock-sensitive dust 19 being far away from the burster 12. Thus considerations of detonator coreload and length inside the burster are minimal. A test was conducted using 29 inches of 100 grain/foot detonating cord. A second charge of C4 used to detonate the liquid/dust cloud was fired 26 ms after the burster 12 was exploded. The results of this test are shown in FIG. 2 which indicates that peak pressure is quadruple that of an equal-weight hemisphere of high energy (HE) explosive to a distance of 1.0 m, is equal at 2.0 m, and at 2.5 m becomes ⅔ the HE pressure. The pressure that is obtained with a hybrid warhead will vary greatly with ingredients and delay time. However, the present invention provides munition designers the means to exceed HE pressure very close in and FAE pressures very far out.

The airborne mixing of reactive liquid and dust is not fully understood. A well mixed cloud of dust and liquid is detonable out to the full size of the liquid-air portion. However, it is suspected that the dust-air portion is then in a concentration too lean to detonate. In other words, no pressure enhancement will be measured. This situation is believed to hold with propylene oxide. In a medium or small size cloud, liquid and dust portions are in concentrations that support a detonation and enhanced pressure will be achieved. However, if the cloud is not well mixed, then the dust may be on the rim of the cloud and enhanced pressure will be achieved. In the test performed, data indicated that the liquid was central and the dust on the rim of the cloud. This test succeeded because NPN is a monopropellant that will detonate though in a relatively rich fuel-air ratio. Ethylene oxide though also a monopropellant (it does not need air to burn), still will not detonate in as dense a cloud as NPN. These limitations of balancing the often widely different detonation limits of the reactive liquid and reactive dust should be borne in mind to practice this invention.

To those skilled in the art, many modifications and variations of the present invention are possible in light of the above teachings. It is therefore to be understood that the present invention can be practiced otherwise than as specifically described herein and still will be within the spirit and scope of the appended claims.

I claim:

1. A hybrid warhead comprising:
- a cylindrical body of reactive liquid;
- a first housing around said reactive liquid;
- means for grounding said first housing;
- a cylindrical body of reactive dust surrounding said first housing;
- a second housing around said reactive dust;
- an upper disk;
- means for explosively bursting said first and second housings;
- first and second metallic end plates at opposite ends of said cylindrical body of reactive liquid and said cylindrical body of reactive dust;
- means for connecting said first and said second metallic end plates.
- a plurality of disks located within said reactive dust to facilitate the turbulent mixing of said reactive dust with said reactive liquid;
- said means for grounding said first housing is a metal tape wrapped around said first housing.

2. The device of claim 1 wherein said reactive liquid is selected from the group consisting of normal propyl nitrate, ethylene oxide and propylene oxide, and said reactive dust is selected from the group consisting of pentolite, TNT (2,4,6-trinitrotoluene), RDX (1,3,5-trinitro-1,3,5-triazacyclohexane), HMX (1,3,5,7-tetranitro-1,3,5,7-tetraazacyclooctane), PETN (pentaerythritol tetranitrate) and nitroguanidine.

3. The device of claim 1 wherein said first housing is a 1 gallon plastic container having a screw-on cap.

4. The device of claim 3 wherein said plastic container has been scored at various locations.

5. A hybrid warhead comprising:
- a cylindrical body of reactive liquid;
- a first housing around said reactive liquid;
- means for grounding said first housing;
- a cylindrical body of reactive dust surrounding said first housing;
- a second housing around said reactive dust;
- an upper disk;
- means for explosively bursting said first and second housings;
- first and second metallic end plates at opposite ends of said cylindrical body of reactive liquid and said cylindrical body of reactive dust;
- means for connecting said first and said second metallic end plates.
- a plurality of disks located within said reactive dust to facilitate the turbulent mixing of said reactive dust with said reactive liquid.

6. The device of claim 1 wherein said means for explosively bursting said first and said second housing is a frangible tube containing a folded detonating cord and an electric detonator and sealed at the top with an inert putty.

7. The device of claim 1 wherein said second housing is a cardboard cylinder.

8. The device of claim 7 wherein said second housing has been scored at various locations.

9. The device of claim 8 wherein said scoring is a pattern of 6 to 10 vertical scores crossed at 45 degrees by an additional 6 to 10 scores.

10. The device of claim 1 wherein said first and second metallic plates are steel.

11. The device of claim 1 wherein said first and second metallic plates are aluminum.

12. The device of claim 1 wherein said means for connecting said first and second metallic end plates is four $\frac{3}{8}$-16 threaded rods.

* * * * *